US006145454A

United States Patent [19]

Barna

[11] Patent Number: 6,145,454

[45] Date of Patent: Nov. 14, 2000

[54] TANGENTIALLY-FIRED FURNACE HAVING REDUCED NOX EMISSIONS

[75] Inventor: Joseph J. Barna, Mooresville, N.C.

[73] Assignee: Duke Energy Corporation, Charlotte, N.C.

[21] Appl. No.: 09/452,003

[22] Filed: Nov. 30, 1999

[51] Int. Cl.[7] ..... F23D 1/00; F23C 1/12

[52] U.S. Cl. ..... 110/347; 110/346; 110/264; 110/261

[58] Field of Search ..... 110/264, 265, 110/190, 232, 233, 234, 244, 261, 262, 106, 108, 346, 245, 347

[56] References Cited

U.S. PATENT DOCUMENTS

| | | | |
|---|---|---|---|
| 3,317,538 | 5/1967 | Freed et al. . | |
| 4,144,017 | 3/1979 | Barsin et al. . | |
| 4,304,196 | 12/1981 | Chadshay et al. . | |
| 4,329,932 | 5/1982 | Takahashi et al. . | |
| 4,403,941 | 9/1983 | Okiura et al. . | |
| 4,426,939 | 1/1984 | Winship . | |
| 4,434,747 | 3/1984 | Chadshay . | |
| 4,438,709 | 3/1984 | Borio et al. . | |
| 4,501,204 | 2/1985 | McCartney et al. . | |
| 4,528,918 | 7/1985 | Sato et al. . | |
| 4,672,900 | 6/1987 | Santalla et al. . | |
| 4,716,844 | 1/1988 | Koch . | |
| 4,934,284 | 6/1990 | Nitz et al. . | |
| 4,989,549 | 2/1991 | Korenberg . | |
| 4,991,520 | 2/1991 | Tsummura et al. . | |
| 4,993,332 | 2/1991 | Boross et al. . | |
| 5,020,454 | 6/1991 | Hellewell et al. . | |
| 5,195,450 | 3/1993 | Marion | 110/347 |
| 5,311,829 | 5/1994 | Clark et al. . | |
| 5,315,939 | 5/1994 | Rini et al. . | |
| 5,343,820 | 9/1994 | Marion . | |
| 5,417,564 | 5/1995 | Briggs . | |
| 5,626,085 | 5/1997 | Donais et al. | 110/188 |
| 5,724,897 | 3/1998 | Breen et al. . | |
| 5,765,488 | 6/1998 | Vatsky . | |
| 5,769,008 | 6/1998 | Finker et al. . | |
| 5,771,823 | 6/1998 | Vierstra et al. . | |
| 5,992,337 | 11/1999 | Phillipe et al. | 110/348 |

*Primary Examiner*—Denise L. Ferensic
*Assistant Examiner*—Ken B. Rinehart
*Attorney, Agent, or Firm*—Kennedy Covington Lobdell & Hickman

[57] ABSTRACT

A furnace of a pulverized coal firing boiler includes a coutant bottom and walls intersecting with the coutant bottom and extending generally vertically therefrom to enclose and define an interior combustion chamber. A first windbox disposed in a corner of the combustion chamber includes therein a vertical array of consecutively spaced coal compartments. A coal nozzle of the lowermost coal compartment of the vertical array is disposed at least ten feet from the intersection of the walls with the coutant bottom. A second coal nozzle is disposed within a second adjacent coal compartment at a first vertical spacing to the first coal nozzle; a third coal nozzle is disposed within a third adjacent coal compartment at a second vertical spacing to the second coal nozzle; and a fourth coal nozzle is disposed within a fourth adjacent coal compartment at a third vertical spacing to the second coal nozzle. The first vertical spacing is less than the second vertical spacing, and the second vertical spacing is less than the third vertical spacing. A second windbox also is disposed below the first windbox and includes a coal nozzle disposed therein that is located within ten feet of the intersection of the walls and the coutant bottom.

15 Claims, 8 Drawing Sheets

TANGENTIALLY-FIRED FURNACE HAVING REDUCED NOX EMISSIONS

FIELD OF THE PRESENT INVENTION

The field of the present invention relates to improvements in tangentially-fired furnaces that are intended to minimize NOx emissions.

BACKGROUND OF THE PRESENT INVENTION

Pulverized coal-fired boilers are often used by electric utility companies in the United States. Furthermore, as a result of recent governmental regulation, levels of NOx emissions from pulverized coal firing boilers have been set which cannot be exceeded, and subsequently, numerous efforts have been undertaken to develop and implement changes to older pulverized coal firing boilers to bring NOx emissions within prescribed limits.

Pulverized coal-fired boilers typically include either wall-fired furnaces or tangentially-fired furnaces. Furthermore, while each type of furnace utilizes combustion for the production of heat, the differences between these two types of furnaces in the delivery of air and fuel into the combustion chamber have resulted in widely differing approaches to improvements therein for the reduction of NOx emissions. Thus, for example, U.S. Pat. No. 5,417,564 to Briggs; U.S. Pat. No. 4,991,520 to Tsumura et al.; and U.S. Pat. No. 4,403,941 to Okiura et al. each represent specific improvements to wall-fired furnaces intended to lower NOx emissions.

In contrast, improvements in boilers having tangentially-fired furnaces are separately represented by U.S. Pat. No. 4,672,900 to Santalla et al.; U.S. Pat. No. 4,501,204 to McCartney et al.; U.S. Pat. No. 5,311,829 to Clark et al.; U.S. Pat. No. 5,343,820 to Marion; U.S. Pat. No. 5,315,939 to Rini et al.; U.S. Pat. No. 4,426,939 to Winship; U.S. Pat. No. 5,626,085 to Donais et al.; and U.S. Pat. No. 5,020,454 to Hellewell et al.

The present invention belongs to the latter group of references, as the present invention specifically relates to decreasing NOx emissions in tangentially-fired furnaces. In this regard, a tangentially-fired furnace 20 representative of the state-of-the-art is shown in FIG. 1 and comprises a vertical combustion chamber 22 that is generally rectangular in cross-section and that includes in each of the four corners thereof a plenum chamber known as a windbox 24. For clarity of illustration, only two such windboxes 24 are shown in FIG. 1. Each windbox 24 is comprised of coal compartments through which passes coal and primary air for initial combustion, and auxiliary air compartments through which passes additional air for maintaining combustion. Furthermore, each windbox 24 and, specifically, each coal nozzle of each windbox 24, is located at least ten feet from a coutant bottom 26 of the furnace. The furnace also includes separate overfire air (SOFA) compartments 28 disposed above and separate from the windboxes 24 for introduction of additional air into the top of the combustion chamber for completing the final stages of combustion. The additional air can be introduced in opposition to the air flow within the furnace as shown, or introduced with the existing air flow within the furnace as is more common. In either case, use of SOFA compartments in tangentially-fired furnaces has been shown to reduce NOx emissions in tangentially-fired furnaces.

Conventional wisdom holds that by dividing the total amount of air (oxygen) between both the windboxes and the SOFA compartments, which otherwise would pass entirely through the windboxes, oxygen concentrations at each stage of combustion in the furnace is decreased. The decreased levels of oxygen, in turn, reduces the oxygen available for formation of NOx at each stage of combustion which, consequently, reduces the overall NOx produced. Conventional wisdom also holds that the reduction of oxygen at each stage of combustion further reduces the temperature at each stage of combustion which, in turn, reduces NOx produced at each stage of combustion as well as the overall NOx produced.

A conventional windbox 30 itself is shown in detail in FIG. 2 and comprises a vertical array of adjacent coal compartments 32 separated from each other by an auxiliary air compartment 34. Each coal compartment 32 includes a coal delivery pipe 36, a coal nozzle 38, and a coal tip 40 also known as a coal bucket. Pulverized coal carried in an air stream of primary air is delivered into the combustion chamber via the coal delivery pipe 36 and coal nozzle 38 and is directed into the combustion chamber by the coal tip 40. Air openings 42 are also provided in the coal compartments 32 for introduction of air, known as "fuel air," in direct proximity to the primary air to assist in the initial combustion of the coal. The auxiliary air compartments 34 disposed between the coal compartments 32 in the windbox 30 include air nozzles 44 for introduction of the auxiliary air into the combustion chamber. One of the auxiliary air compartments shown also includes an optional auxiliary burner 46 for further control of the stabilization of combustion at low coal loads. The primary air, fuel air, and auxiliary air are directed into the combustion chamber generally tangentially to an imaginary circle within the combustion chamber for the creation of a fireball therein like that shown in FIG. 1.

While the furnace of FIG. 1 includes SOFA compartments, other conventional but older furnaces do not include SOFA compartments and exhibit higher NOx emissions. Such a conventional but older furnace is shown, for example, in FIG. 3, and includes four windboxes 48 each installed in a corner of the furnace, only one of which is shown for clarity of illustration. Each windbox 48 includes, vertically spaced therein from bottom to top thereof: a first auxiliary air compartment 52 commonly referred to as an end air compartment; a first coal compartment 54; a second auxiliary air compartment 56; a second coal compartment 58; a third auxiliary air compartment 60; a third coal compartment 62; a fourth auxiliary air compartment 64; a fourth coal compartment 66; a fifth auxiliary air compartment 68; a fifth coal compartment 70; a sixth auxiliary air compartment 72; a sixth coal compartment 74; and a second end air compartment 76. Furthermore, coal nozzles 78 disposed within the coal compartments 54,58,62,66,70,74 are evenly spaced vertically apart, as is conventional. In the particular windbox 48 shown, the coal nozzles 78 are spaced 5'4" apart from one another.

Since the older furnace including windboxes 48 exhibit higher levels of NOx emissions, a retrofitting method for each windbox 48 has been developed which results in lower levels of NOx emissions. The resulting retrofitted windbox 50 is shown in FIG. 4 and includes, vertically spaced therein from bottom to top thereof: a first auxiliary air compartment 80 commonly referred to as an end air compartment; a first coal compartment 82; a second auxiliary air compartment 84; a second coal compartment 86; a third auxiliary air compartment 88; a third coal compartment 90; a fourth auxiliary air compartment 92; a fourth coal compartment 94; a fifth auxiliary air compartment 96; a fifth coal compartment 98; a sixth auxiliary air compartment 100; a sixth coal compartment 102; and, then, three consecutive closed coupled overfire air (CCOFA) compartments 104,106,108.

As will be apparent in contrasting the retrofitted windbox 50 with the older windbox 48, a coal nozzle has been removed from the top of the original windbox 48 and a coal nozzle 110 has been installed between two remaining coal nozzles 112,114 in order to accommodate the new CCOFA compartments 104,106,108. The retrofitted windbox 50 subsequently includes a spacing of 5'4" respectively between coal nozzles disposed within the first, second, third, and fourth coal compartments, but includes a spacing of only 2'8" respectively between the coal nozzles disposed within the fourth, fifth, and sixth coal compartments.

In the retrofitted windbox of FIG. 4, overall NOx emissions are reduced as a result of the diversion of a greater amount of the total air to the upper levels of the windbox 50 from the lower and middle levels of the windbox 50 that correlate with the initial and middle stages of combustion. However, it is believed that the temperature at each stage of combustion actually increases adjacent the fourth, fifth, and sixth coal compartments as a result of their necessary disposition closer to one another for accommodation of the CCOFA compartments, thereby counteracting to some extent the decreased NOx produces by the diversion of air to the CCOFA compartments.

The present invention advances the state-of-the-art of tangentially fired furnaces by providing additional improvements therein for the reduction of NOx emissions and, in particular, by providing an alternative retrofitting method to the conventional retrofitting method described above.

SUMMARY OF THE PRESENT INVENTION

Briefly described, the present invention includes a tangentially-fired furnace having a coutant bottom and walls intersecting with the coutant bottom and extending generally vertically therefrom to enclose and define an interior combustion chamber; and, a windbox disposed on the walls and having therein a coal compartment including a coal nozzle that is disposed within at least ten feet of the intersection of the walls with the coutant bottom. In a feature of the present invention, the aforementioned coal compartment is disposed within a windbox located entirely within ten feet of the intersection of the walls with the coutant bottom, and below a larger windbox including therein a vertical array of consecutively spaced coal compartments located outside of ten feet of the intersection of the walls with the coutant bottom.

The present invention also includes a windbox having a vertical array of at least four consecutively spaced coal compartments each including a coal nozzle. A first coal compartment being the lowermost of the vertical array, the second, third, and fourth coal compartment are consecutively spaced therefrom. Moreover, the coal nozzle of the first coal compartment is disposed at a first vertical spacing to the coal nozzle of the second coal compartment, the coal nozzle of the second coal compartment is disposed a second vertical spacing to the coal nozzle of the third coal compartment, and the coal nozzle of the third coal compartment is disposed a third vertical spacing to the coal nozzle of the fourth coal compartment. In accordance with the present invention, the first vertical spacing is less than the second vertical spacing, and the second vertical spacing is less than the third vertical spacing, whereby the vertical spacing between coal compartments consecutively increases from bottom to top in the vertical array.

The method of the present invention relates to the retrofitting a furnace of a pulverized coal firing boiler, the furnace including a coutant bottom and walls intersecting with the coutant bottom and extending generally vertically therefrom to enclose and define an interior combustion chamber, and a first windbox disposed on one of the walls and having therein a vertical array of coal compartments with adjacently spaced coal compartments being separated by an auxiliary air compartment. Furthermore, as is conventional, the lowermost coal nozzle of the vertical array is disposed at least ten feet from the intersection of the walls and the coutant bottom.

The method comprises the steps of removing a coal compartment from the first windbox and disposing a second windbox on the walls having a coal compartment therein with the coal nozzle thereof being located within ten feet of the intersection of the walls with the coutant bottom.

A second retrofitting method of the present invention includes the respacing of a vertical array of at least four consecutively spaced coal compartments within a conventional windbox, each coal compartment including a coal nozzle disposed therein with all coal nozzles within the windbox being evenly spaced vertically apart. In accordance with the second method, the vertical spacing between the coal nozzles of the coal compartments is altered such that: a first coal nozzle of the first coal compartment is located at a first vertical spacing adjacent to a second coal nozzle disposed within the second coal compartment; the second coal nozzle is located at a second vertical spacing adjacent to a third coal nozzle disposed within the third coal compartment; and the third coal nozzle is located at a third vertical spacing adjacent to a fourth coal nozzle disposed within a fourth coal compartment. In accordance with the present invention, the first vertical spacing is less than the second vertical spacing, and the second vertical spacing is less than the third vertical spacing.

BRIEF DESCRIPTION OF THE DRAWINGS

Preferred embodiments of the present invention will now be described in detail with reference to the accompanying drawings, wherein.

DETAILED DESCRIPTION OF PREFERRED EMBODIMENTS

Figure 5:
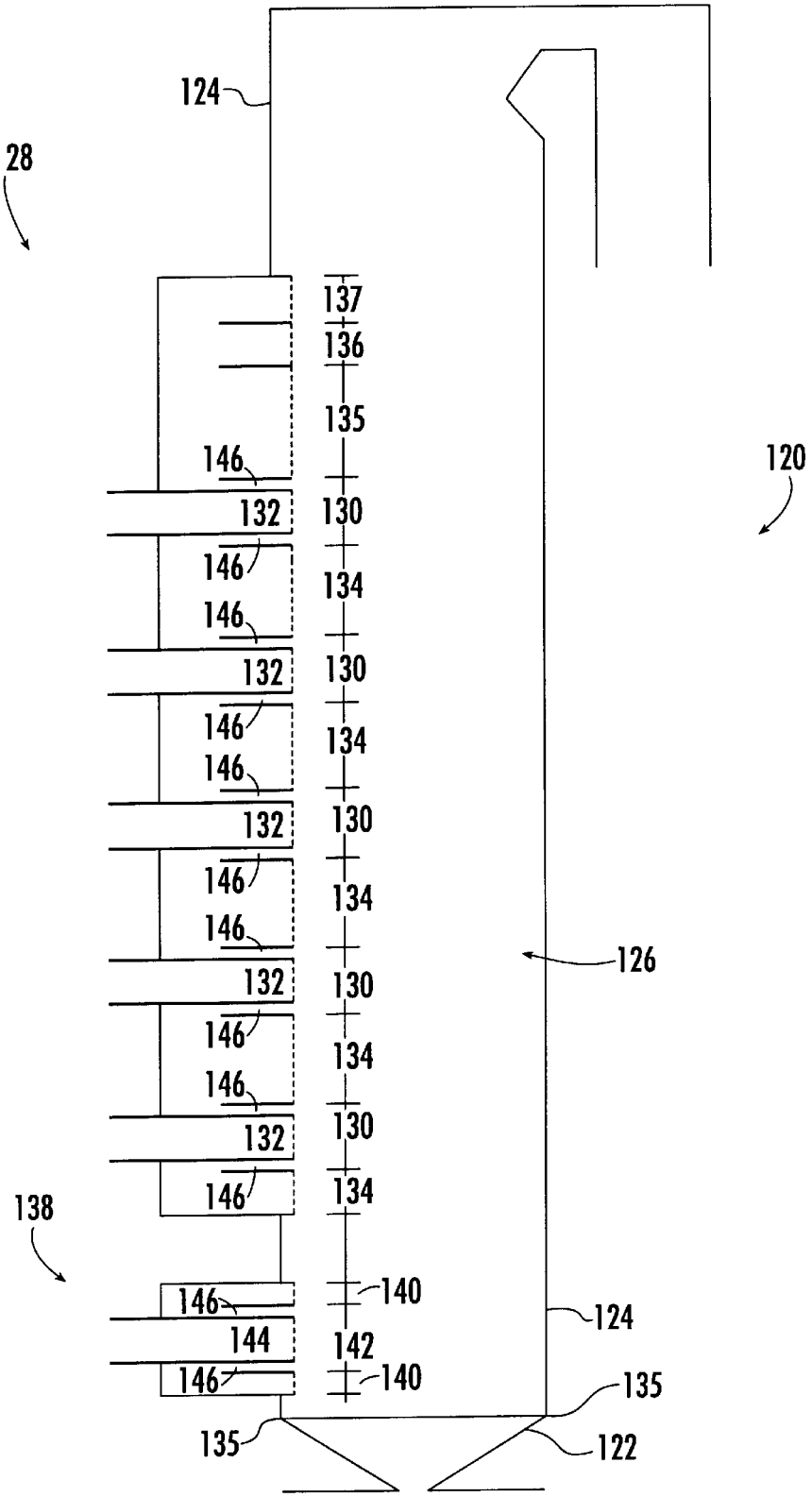
FIG. 5 is an elevational view of a tangentially-fired furnace in accordance with the present invention.

A preferred tangentially-fired furnace 120 is shown schematically in FIG. 5. The furnace 120 includes a coutant bottom 122 and walls 124 intersecting with the coutant bottom 122 and extending generally vertically therefrom to enclose and define an interior combustion chamber 126. The combustion chamber 126 preferably is rectangular in cross-section.

A first windbox 128 is disposed at a corner of the combustion chamber 126 and includes a vertical array of consecutively spaced coal compartments 130 each having a coal nozzle 132. Furthermore, each adjacently spaced coal compartment is separated by an auxiliary air compartment 134, and the coal nozzle 132 disposed within the lowermost of the coal compartments 30 is located at least ten feet from the intersection 135 of the walls 124 with the coutant bottom 122.

With regard to the arrangement of compartments, windbox 128 comprises vertically spaced therein from bottom to top thereof: a first auxiliary air compartment 134 commonly referred to as end air; a first coal compartment 130; a second auxiliary air compartment 134; a second coal compartment 130; a third auxiliary air compartment 134; a third coal compartment 130; a fourth auxiliary air compartment 134; a fourth coal compartment 130; a fifth auxiliary air compartment 134; a fifth coal compartment 130; and three adjacent CCOFA compartments 135,136,137.

In accordance with the present invention, a second windbox 138 is disposed at the same corner below the first windbox 128. Windbox 138 comprises vertically spaced therein from bottom to top: a first auxiliary air compartment 140; a first coal compartment 142; and a second auxiliary air compartment 140. The coal compartment 142 itself includes a coal nozzle 144 disposed within ten feet of the intersection 135 of the walls 124 with the coutant bottom 122 of the furnace 120. Furthermore, an empty spacing extends along the walls 124 of the corner of the combustion chamber 126 between the first and second windboxes 128,136.

While not shown for clarity of illustration, the furnace 120 also includes windboxes identical to windboxes 128,138 similarly disposed in the other three corners of the combustion chamber 126.

Figure 1:
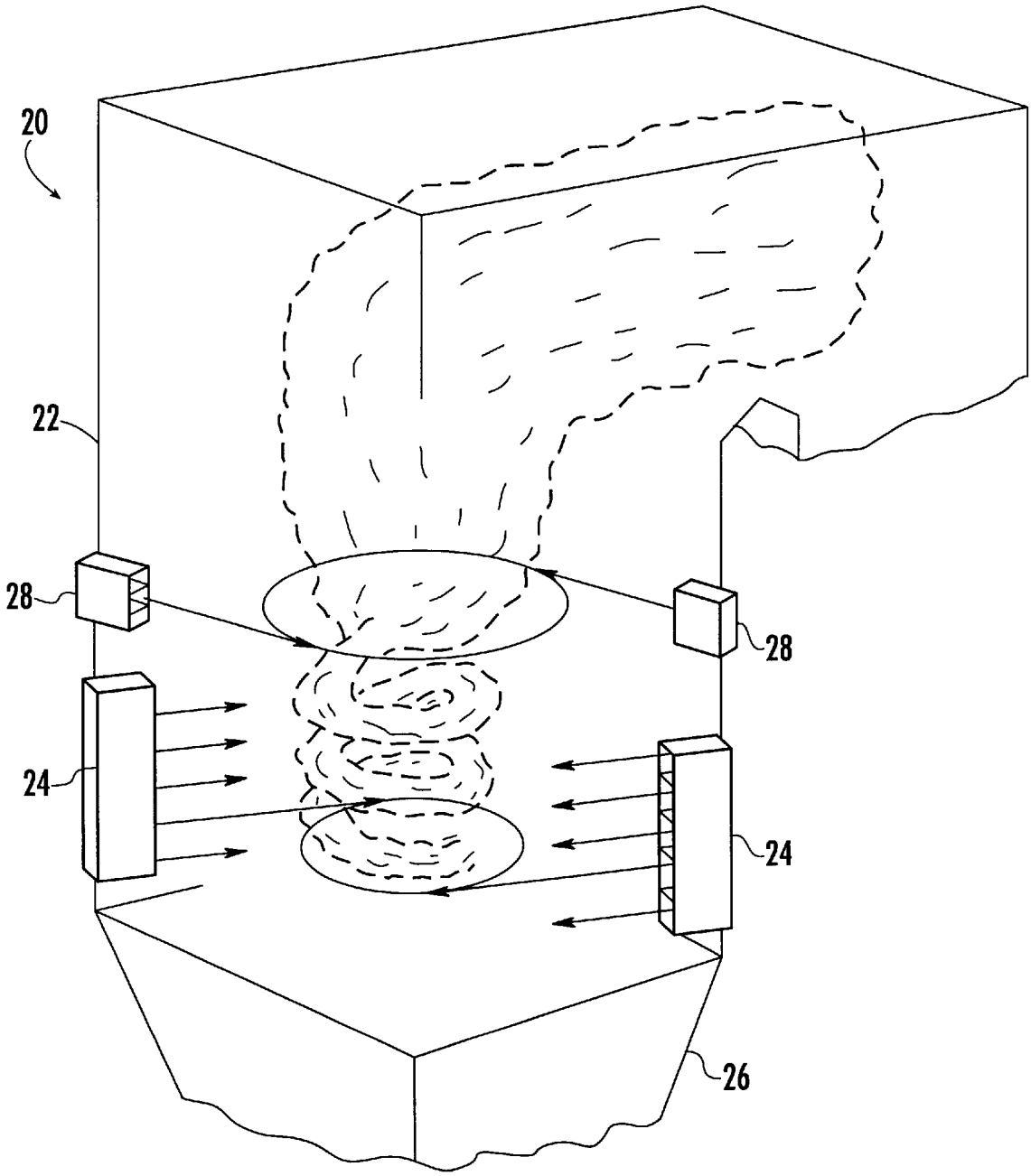
FIG. 1. (PRIOR ART)
FIG. 1 is a perspective view of a conventional tangentially-fired furnace.
Figure 2:
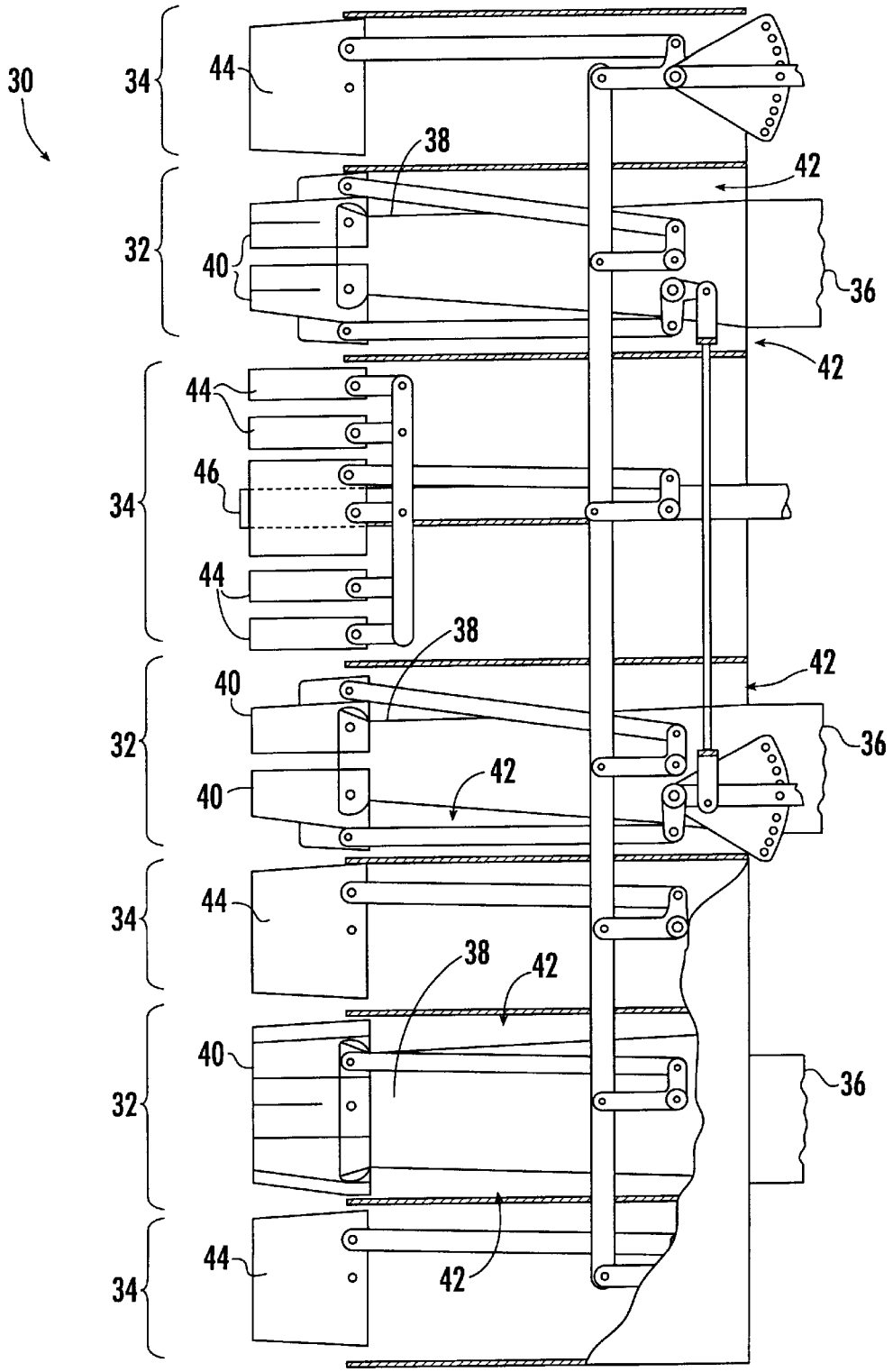
FIG. 2. (PRIOR ART)
FIG. 2 is an elevational, partially broken-away view of a side of a conventional windbox.

The structure of each coal compartment and auxiliary compartment of the first and second windboxes 128,138 is conventional and the compartments themselves correspond, for example, to those illustrated in FIG. 2 described above. Thus, for example, all of the coal nozzles disposed within the first windbox are evenly spaced vertically apart, and each coal compartment 130,142 includes air conduits 146 for the introduction of fuel air into the combustion chamber 126.

Figure 6:
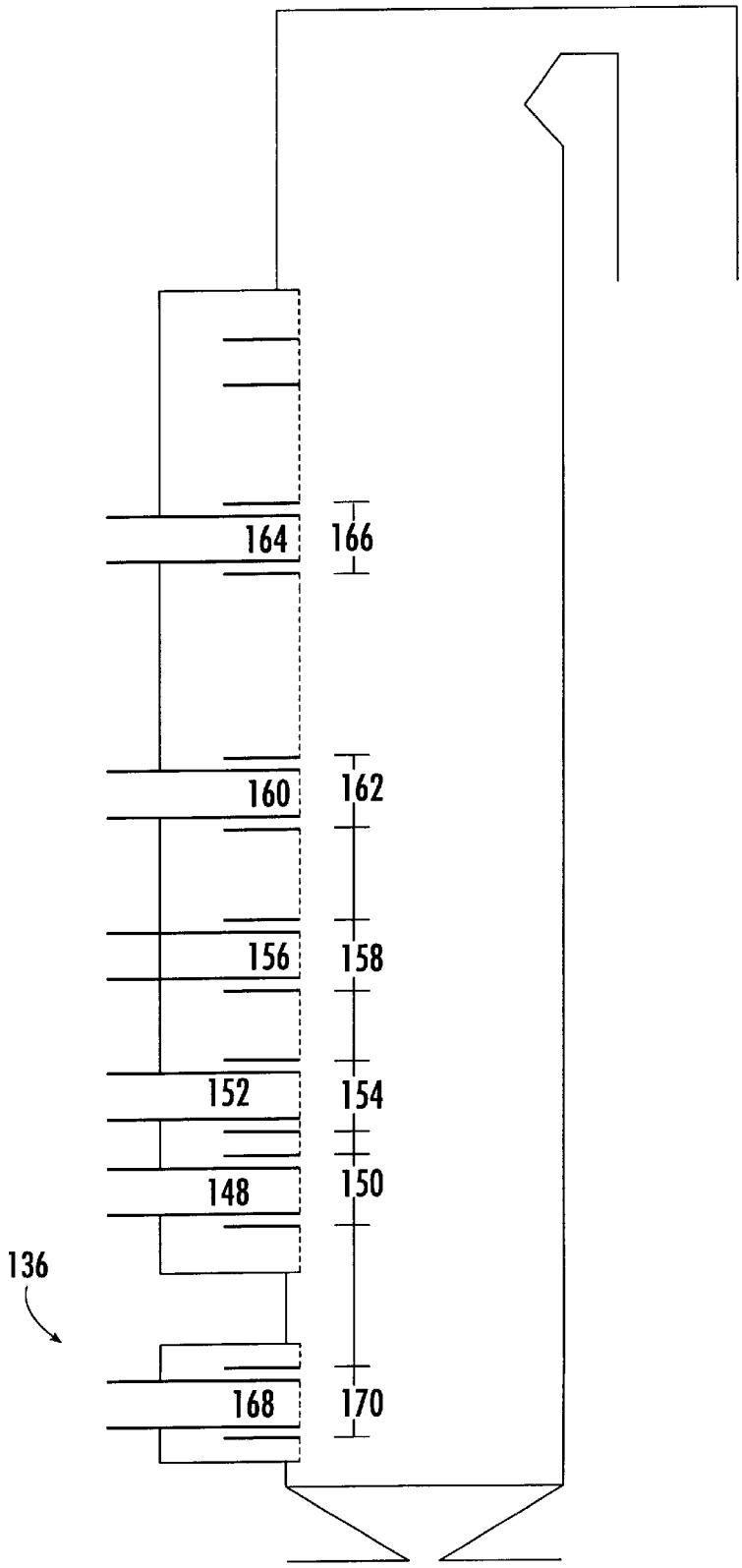
FIG. 6 is an elevational view of another tangentially-fired furnace in accordance with the present invention.

Another furnace in accordance with the present invention is shown in FIG. 6, wherein consecutively spaced coal compartments of a first windbox are disposed at increasing distances apart. In particular, in this further preferred embodiment a coal nozzle 148 disposed within a first, lowermost coal compartment 150 is spaced approximately two feet from a coal nozzle 152 disposed within a second adjacently spaced coal compartment 154; the coal nozzle 152, in turn, is disposed three feet and four inches from a coal nozzle 156 disposed within a third coal compartment 158 adjacently spaced to the second coal compartment 154; the coal nozzle 156 likewise is disposed five feet and four inches from a coal nozzle 160 disposed within a fourth coal compartment 162 adjacently spaced to the third coal compartment 158; and the coal nozzle 160 is disposed ten feet and eight inches from a coal nozzle 164 disposed within a fifth coal compartment 166 adjacently spaced to the fourth coal compartment 160. Additionally, a coal nozzle 168 disposed within a coal compartment 170 of a second windbox is disposed nine feet and ten inches from the coal nozzle 148 disposed within the first coal compartment 150 of the first windbox.

Figure 7:
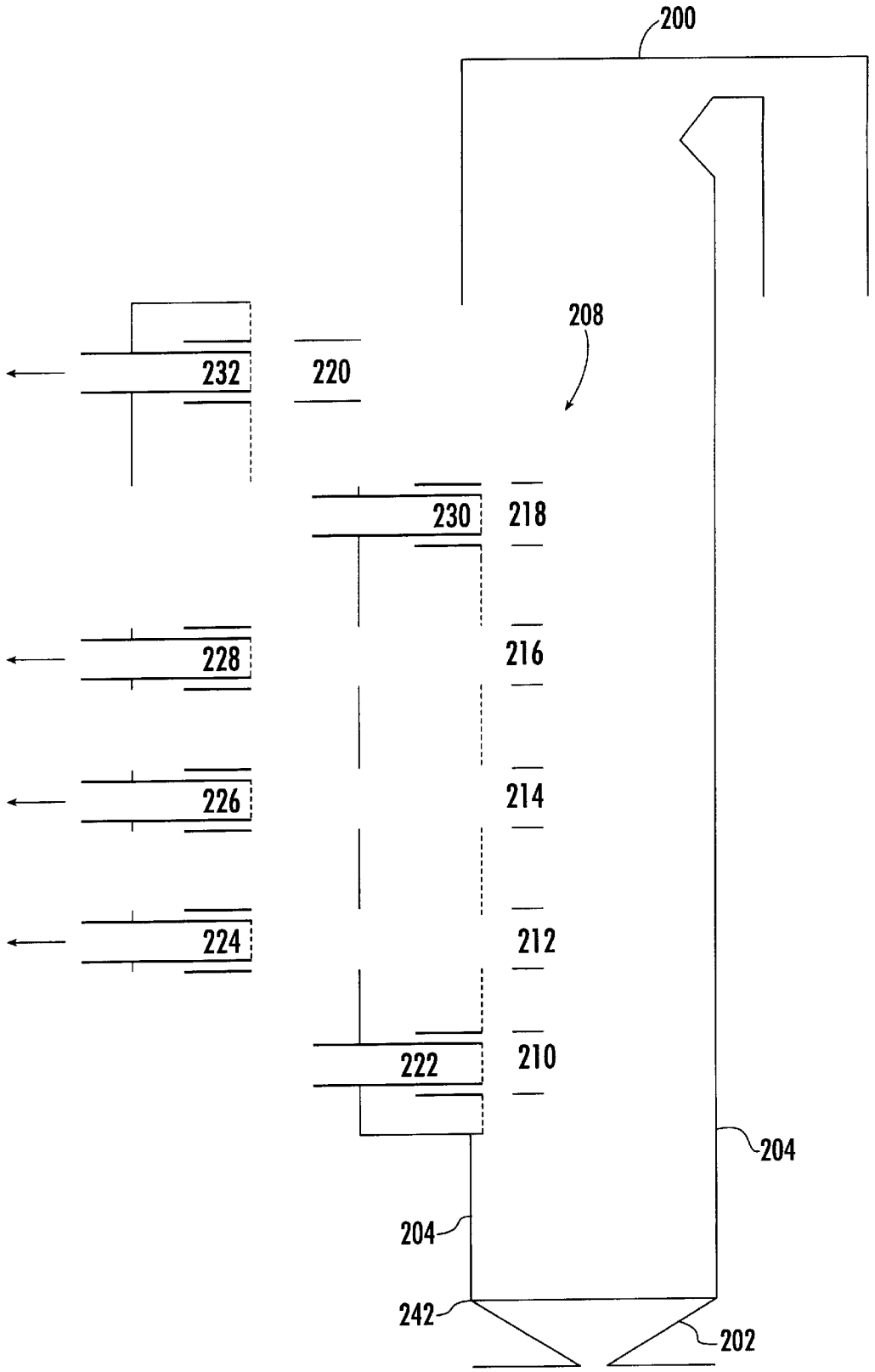
FIG. 7 is an elevational view of a tangentially-fired furnace undergoing retrofitting in accordance with the present invention.

The method of the present invention relates to the retrofitting a conventional furnace 200 of a pulverized coal firing boiler as shown in FIG. 7. In particular, the furnace 200 including a coutant bottom 202 and walls 204 intersecting with the coutant bottom 202 and extending generally vertically therefrom to enclose and define an interior combustion chamber 206, and a first windbox 208 disposed in a corner of the walls 204 and having therein a vertical array of coal compartments 210,212,214,216,218,220. Furthermore, the coal compartments include coal nozzles 222,224,226,228, 230,232 evenly spaced vertically apart therein.

Figure 8:
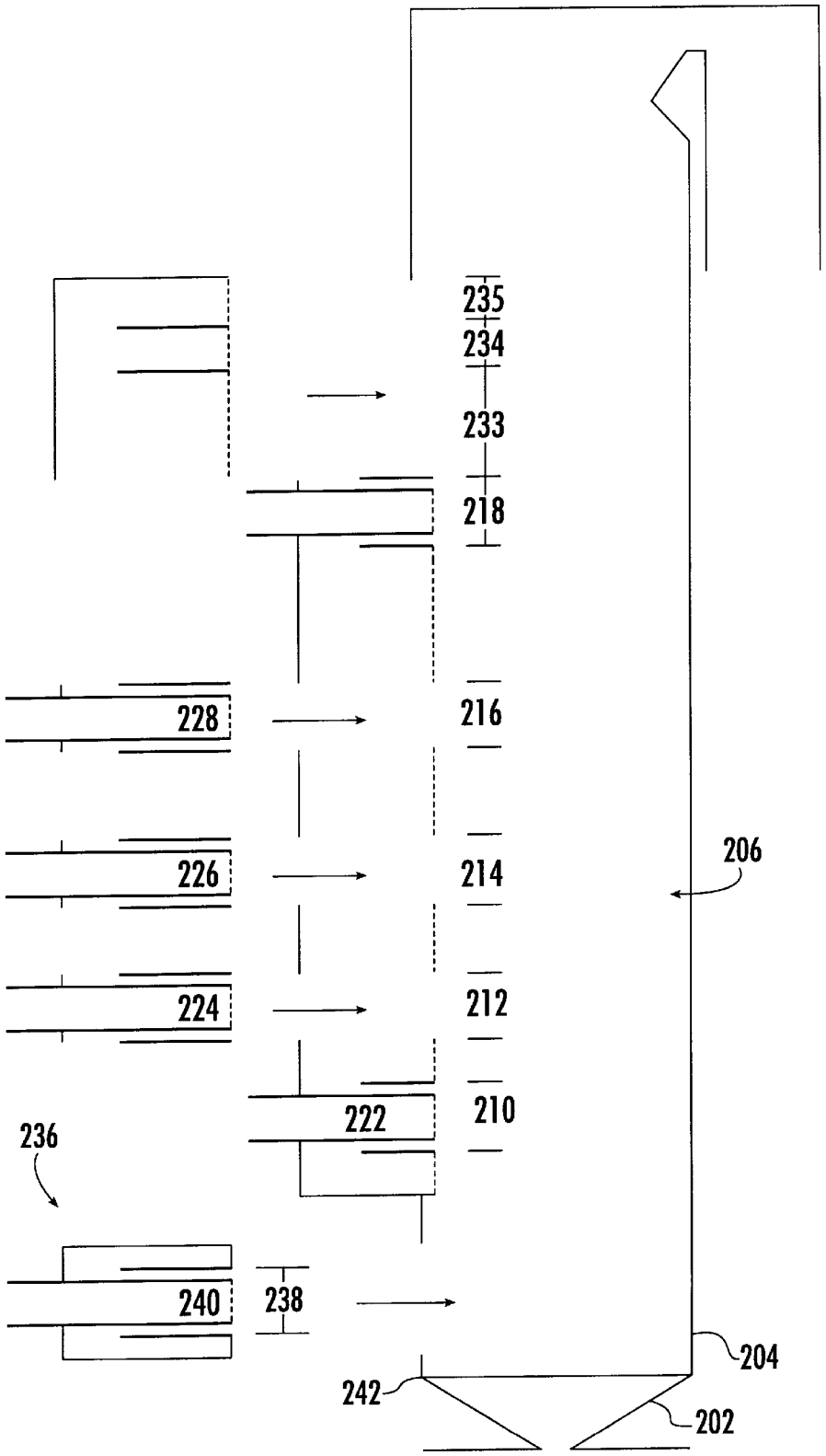
FIG. 8 is another elevational view of the furnace of FIG. 7.

The method includes the steps of converting coal compartment 220 and the surrounding auxiliary air compartments in the first windbox 208 (see FIG. 7) into CCOFA compartments 233,234,235, as schematically represented in FIGS. 7 and 8. In particular, in the retrofitting method the coal nozzle 232 is removed from the first windbox 208. Moreover, as further shown in FIG. 8, a second windbox 236 is installed in the same corner of the furnace below the first windbox 208 and a coal compartment 238 with a coal nozzle 240 is located therein such that the coal nozzle 240 is vertically spaced within ten feet of the intersection 242 of the walls 204 with the coutant bottom 202.

An additional method of the present invention includes the respacing of the distances between coal nozzles 222, 224,226,228,230 of coal compartments 210,212,214,216, 218 in the first windbox 208 such that: coal nozzle 222 disposed within the lowermost coal compartment 210 is located at a first vertical spacing adjacent to coal nozzle 224 disposed within coal compartment 212; coal nozzle 224 is located at a second vertical spacing adjacent to coal nozzle 226 disposed within coal compartment 214; coal nozzle 226 is located at a third vertical spacing adjacent to coal nozzle 228 disposed within coal compartment 216; and coal nozzle 228 is located at a fourth vertical spacing adjacent to coal nozzle 230 disposed within coal compartment 218. Moreover, in this arrangement, the first vertical spacing is less than the second vertical spacing, the second vertical spacing is less than the third vertical spacing, and the third vertical spacing is less than the fourth vertical spacing. This respacing of the distances between adjacent coal nozzles involves the removal of coal compartments 224,226,228 as shown in FIG. 7 and their reinstallation at the appropriate spacings as shown in FIG. 8.

Figure 3:
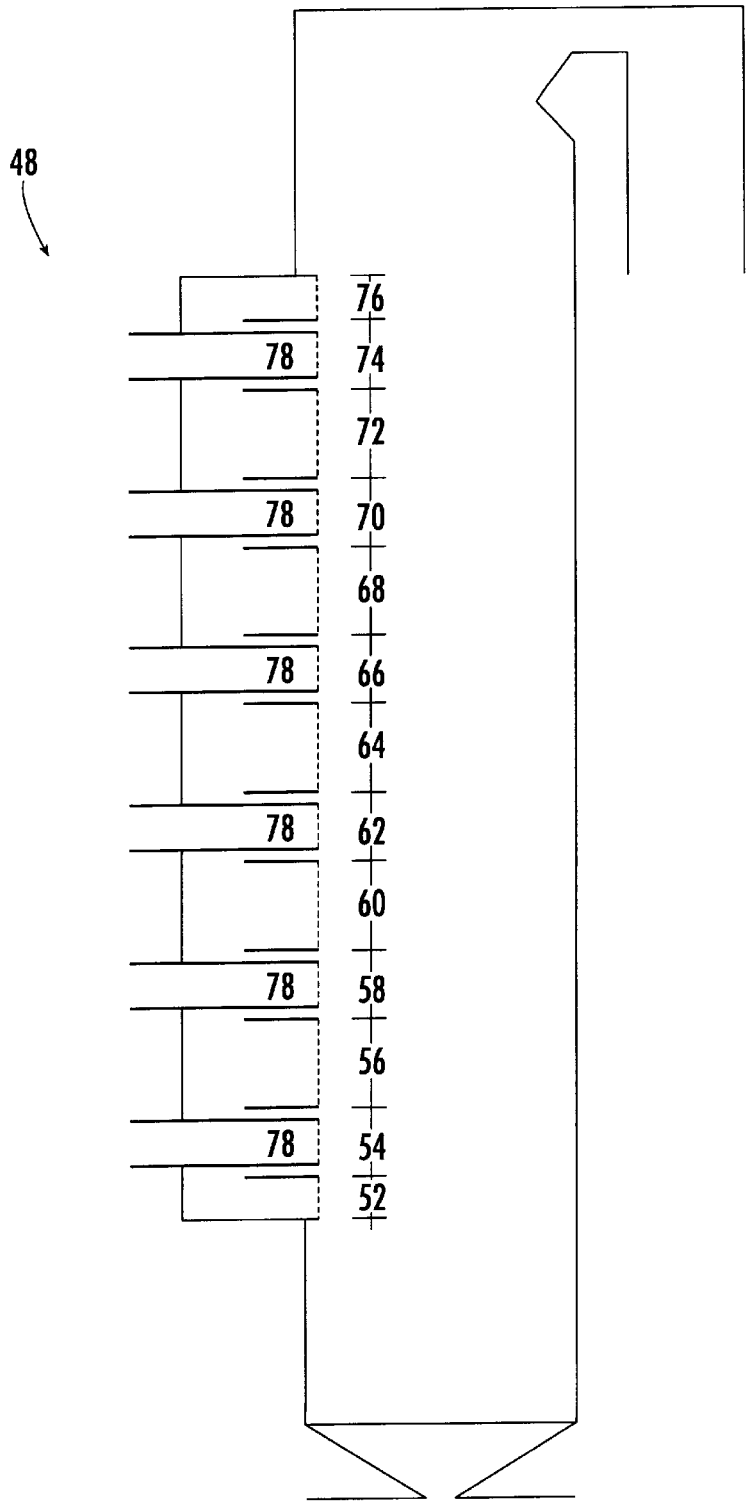
FIG. 3. (PRIOR ART)
FIG. 3 is an elevational view of a tangentially-fired furnace including a conventional, older windbox.
Figure 4:
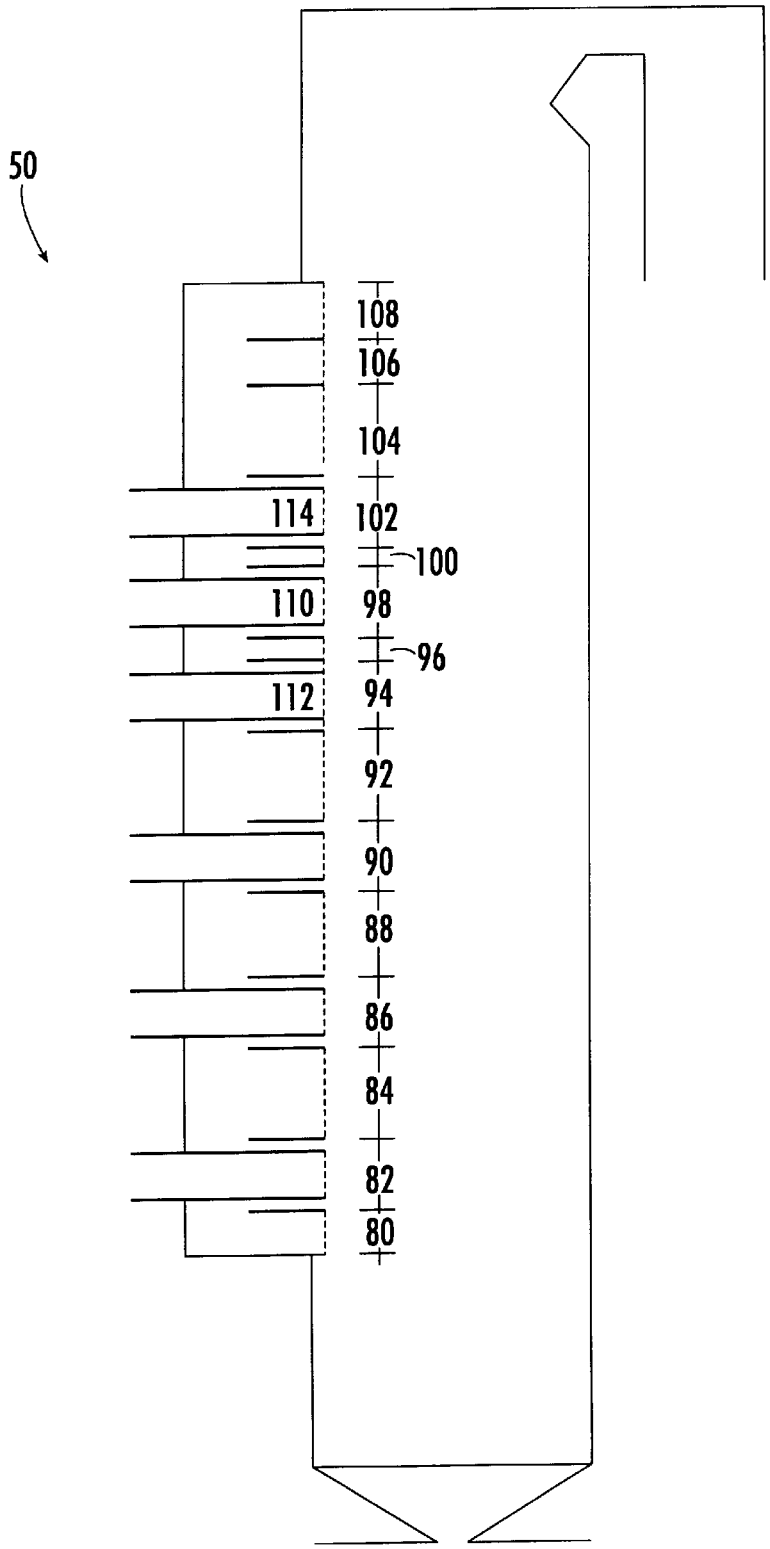
FIG. 4. (PRIOR ART)
FIG. 4 is an elevational view of a tangentially-fired furnace including a windbox retrofitted in accordance with a conventional method.

The retrofitting method of the present invention includes not only the conversion of conventional, older windboxes such as that of FIG. 3 into the windboxes of the present invention as shown in FIGS. 5 and 6, but also the conversion of conventional state-of-the-art windboxes such as that shown in FIG. 4 into the windboxes of the present invention as shown in FIGS. 5 and 6.

The temperatures within the combustion chamber of each furnace of FIGS. 3–6 have been estimated for each coal nozzle elevation (with respect to sea level), and are set forth in the following table. In the comparison, Furnace A utilizes the older conventional windbox of FIG. 3, Furnace B utilizes the conventionally retrofitted windbox of FIG. 4, Furnace C utilizes the windboxes of the present invention as shown in FIG. 5, and Furnace D utilizes the windboxes of the present invention as shown in FIG. 6.

| Elevation (Above Sea Level) | Furnace A | Furnace B | Furnace C | Furnace D |
|---|---|---|---|---|
| 817' 6" | 2500 | n/a | n/a | n/a |
| 812' 2" | 2100 | 2650 | 2250 | 2300 |
| 809' 6" | n/a | 2150 | n/a | n/a |
| 806' 10" | 1750 | 1750 | 1900 | n/a |
| 801' 6" | 1450 | 1450 | 1600 | 1900 |
| 796' 2" | 1200 | 1200 | 1350 | 1600 |
| 792' 10" | n/a | n/a | n/a | 1350 |
| 790' 10" | 1000 | 1000 | 1150 | 1150 |
| 781' | n/a | n/a | 1000 | 1000 |

As will be apparent from the table, Furnaces C and D of the present invention each have a longer combustion zone due to the addition of the second windbox and, therefore, each furnace has a maximum peak temperature throughout the combustion zone that is less than that of Furnaces A and B This reduction in the maximum temperature reached during combustion combined with the lengthening of the combustion zone results in a reduction in the overall NOx produced. Furthermore, as a result of the respacing of the coal nozzles in the windbox of Furnace D, the temperature in Furnace D increases faster than any of the other furnaces and maintains less of deviation from the peak temperature throughout the upper levels of combustion. This faster increase in and maintenance of the temperature throughout a longer portion of the combustion zone further reduces NOx emissions.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor to be construed to limit the present invention or otherwise to exclude any such other embodiments, adaptations, variations, modifications and equivalent arrangements, the present invention being limited only by the claims appended hereto and the equivalents thereof.

For example, while the present invention relates to a tangentially-fired furnace designed to minimize NOx emissions in a pulverized coal boiler, other types of fuel—such as oil and natural gas—can be used with the furnaces of the present invention just as these fuels are sometimes used in conventional furnaces designed primarily for pulverized coal.

What is claimed is:

1. A tangentially-fired furnace, comprising:

(a) a coutant bottom and walls intersecting generally horizontally with said coutant bottom and extending generally vertically therefrom to enclose and define an interior combustion chamber;

(b) a first windbox located at an intersection of two of said walls and having therein a vertical array of adjacently spaced coal compartments each including a coal nozzle, a said coal nozzle of the lowermost coal compartment being located at least ten feet from the intersection of said walls with said coutant bottom; and (c) a second windbox located at said intersection of said two walls and having therein a coal compartment with a coal nozzle and an air opening located in proximity thereto for admission of fuel air, said coal nozzle within said coal compartment of said second windbox being located within ten feet of said intersection of said walls with said coutant bottom.

2. The furnace of claim 1, wherein each said coal compartment of said first windbox is vertically located between auxiliary air compartments that deliver auxiliary air into said combustion chamber.

3. The furnace of claim 1, wherein said coal compartment of said second windbox is vertically located between auxiliary air compartments.

4. The furnace of claim 1, wherein said first windbox is vertically spaced from said second windbox.

5. The furnace of claim 1, wherein each said coal compartment further includes a coal delivery pipe and a coal bucket.

6. The furnace of claim 1, where each said coal compartment of said first windbox further includes an air opening located in proximity to said coal nozzle for admission of fuel air into said combustion chamber.

7. The furnace of claim 1, wherein said vertical array of adjacently spaced coal compartments includes consecutively spaced first, second, third, and fourth coal compartments, said first coal compartment being the lowermost, and wherein a said coal nozzle of said first coal compartment is located at a first vertical spacing to a said coal nozzle of said second coal compartment, said coal nozzle of said second coal compartment is located a second vertical spacing to a said coal nozzle of said third coal compartment, and said coal nozzle of said third coal compartment is located a third vertical spacing to a said coal nozzle of said fourth coal compartment, said first vertical spacing being less than said second vertical spacing and said second vertical spacing being less than said third vertical spacing.

8. A method for retrofitting a furnace of a pulverized coal firing boiler, the furnace including a coutant bottom and walls intersecting with the coutant bottom and extending generally vertically therefrom to enclose and define an interior combustion chamber, and a first windbox located on one of the walls and having therein a vertical array of adjacently spaced coal compartments each having a coal nozzle located therein, a coal nozzle of a lowermost coal compartment of the vertical array being located at least ten feet from the intersection of the walls with the coutant bottom, the method comprising the step of locating a second windbox on the walls having a coal compartment therein with a coal nozzle located within ten feet of the intersection of the walls with the coutant bottom.

9. The method of claim 8, further comprising the step of removing a coal nozzle from a coal compartment of the first windbox.

10. The method of claim 9, wherein each coal compartment includes an air opening located in proximity to the coal nozzle thereof for delivery of fuel air into the combustion chamber.

11. The method of claim 9, wherein said step of removing the coal nozzle comprises removing a coal nozzle from a coal compartment that is the uppermost in the vertical array of coal compartments.

12. The method of claim 11, further comprising the step of installing a closed couple overfire air compartment in the windbox at the location from which the coal compartment is removed.

13. A tangentially-fired furnace, comprising:

(a) a coutant bottom and walls intersecting with said coutant bottom and extending generally vertically therefrom to enclose and define an interior combustion chamber; and (b) a windbox located on said walls and having therein a vertical array of adjacently spaced coal compartments, said vertical array of coal compartments including, (i) a lowermost coal compartment having a first coal nozzle located therein, (ii) a second coal compartment consecutively spaced from said lowermost coal compartment and having a second coal nozzle therein located at a first vertical spacing to said first coal nozzle, (iii) a third coal compartment consecutively spaced from said second coal compartment and having a third coal nozzle located therein at a second vertical spacing to said second coal nozzle, and (iv) a fourth coal compartment consecutively spaced from said third coal compartment and having a fourth coal nozzle located therein at a third vertical spacing to said third coal nozzle, said first vertical spacing being less than said second vertical spacing and said second vertical spacing being less than said third vertical spacing.

14. The furnace of claim 13, further including an auxiliary air compartment located between adjacently spaced coal compartments.

15. A method for retrofitting a furnace of a pulverized coal firing boiler, the furnace including a coutant bottom and walls intersecting with the coutant bottom and extending generally vertically therefrom to enclose and define an interior combustion chamber, and a windbox located on the walls and having therein a vertical array of at least four adjacently spaced coal compartments each having located therein a coal nozzle, the method comprising respacing the coal compartments in the windbox such that, (a) a first coal nozzle located within a lowermost coal compartment of the vertical array is located at a first vertical spacing to a second coal nozzle located within a second coal compartment consecutively spaced to the lowermost coal compartment;

(b) the second coal nozzle is located at a second vertical spacing to a third coal nozzle located within a third coal compartment consecutively spaced to the second coal compartment; and (c) the third coal nozzle is located at a third vertical spacing to a fourth coal nozzle located within a fourth coal compartment consecutively spaced to the third coal compartment, the first vertical spacing being less than the second vertical spacing and the second vertical spacing being less than the third vertical spacing.

* * * * *